US009792846B2

(12) United States Patent
Lim

(10) Patent No.: US 9,792,846 B2
(45) Date of Patent: Oct. 17, 2017

(54) DISPLAY PANEL DRIVER AND DISPLAY DEVICE HAVING THE SAME

(71) Applicant: SAMSUNG DISPLAY CO., LTD., Yongin, Gyeonggi-Do (KR)

(72) Inventor: Sang-Min Lim, Cheonan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 153 days.

(21) Appl. No.: 14/696,772

(22) Filed: Apr. 27, 2015

(65) Prior Publication Data

US 2016/0140891 A1 May 19, 2016

(30) Foreign Application Priority Data

Nov. 17, 2014 (KR) ..... 10-2014-0159858

(51) Int. Cl.
*G09G 3/20* (2006.01)

(52) U.S. Cl.
CPC ..... *G09G 3/2007* (2013.01); *G09G 3/2003* (2013.01); *G09G 2320/0276* (2013.01); *G09G 2320/0626* (2013.01); *G09G 2320/0673* (2013.01)

(58) Field of Classification Search
None
See application file for complete search history.

(56) References Cited

U.S. PATENT DOCUMENTS

2010/0045690 A1* 2/2010 Handschy ..... G09G 3/3629 345/549
2013/0069924 A1* 3/2013 Robinson ..... G09G 3/20 345/207

FOREIGN PATENT DOCUMENTS

KR 10-2011-0133210 A 12/2011
KR 10-2013-0099588 A 9/2013
KR 10-2013-0108822 A 10/2013
KR 10-2014-0013126 A 2/2014
KR 10-2014-0030468 A 3/2014

* cited by examiner

*Primary Examiner* — Joseph Haley
*Assistant Examiner* — Emily Frank
(74) *Attorney, Agent, or Firm* — Lee & Morse, P.C.

(57) ABSTRACT

A display panel driver includes a reference register, a calculator, and a data signal generator. The reference register stores a reference compensation gamma data curve generated by compensating a luminance characteristic deviation of a display panel in a reference luminance mode. The calculator calculates a compensation gamma data curve for each of a plurality of luminance modes based on the reference compensation gamma data curve to perform a dimming operation. The data signal generator generates data signals corresponding to input grayscale levels based on the compensation gamma data curve.

20 Claims, 6 Drawing Sheets

| GRAY | LUM | R | G | B |
|---|---|---|---|---|
| 3 | 0.00803NIT | 6.21485 | 6.26950 | 5.90651 |
| 11 | 0.13NIT | 6.13614 | 6.20253 | 5.82159 |
| 23 | 0.64NIT | 6.03776 | 6.11882 | 5.71543 |
| 35 | 1.58NIT | 5.94676 | 6.04027 | 5.61373 |
| 51 | 3.55NIT | 5.81885 | 5.92699 | 5.46169 |
| 87 | 11.19NIT | 5.53561 | 5.66767 | 5.13960 |
| 151 | 36.63NIT | 5.13535 | 5.29703 | 4.68950 |
| 203 | 69.20NIT | 4.88181 | 5.06398 | 4.39943 |
| 255 | 113NIT | 4.63979 | 4.84155 | 4.12084 |

DISPLAY PANEL DRIVER AND DISPLAY DEVICE HAVING THE SAME

CROSS-REFERENCE TO RELATED APPLICATION

Korean Patent Application No. 10-2014-0159858, filed on Nov. 17, 2014, and entitled, "Display Panel Driver and Display Device Having The Same," is incorporated by reference herein in its entirety.

BACKGROUND

1. Field

One or more embodiments described herein relate a display panel driver and a display device having a display panel driver.

2. Description of the Related Art

A display has pixels that emit light based on data signals that correspond to desired grayscale levels. In such a device, a gamma setting may indicate an adjustment between luminance and grayscale level. According to Weber's law, the human eye reacts more sensitively in a dark situation than a bright situation. Therefore, the relationship between an output luminance level and an input grayscale level (e.g., gamma curve) may be nonlinear. Also, the relationship between the voltage level of a data signal and input grayscale level (e.g., gamma data curve) may be nonlinear.

In terms of structure, a display device may include a register to store setting values. An ideal register may store values in a certain range of an entire range. For example, a register may store a two-digit hexadecimal value in the range of 00 to FF. When the register stores a value exceeding the range, overflow of the register occurs and a boundary value (e.g., 00 or FF) is stored in the register. Such an overflow condition may occur when the register is to store values for a gamma curve in the register. In this case, the boundary value may degrade display quality.

SUMMARY

In accordance with one or more embodiment, a display panel driver includes a reference register to store a reference compensation gamma data curve, the reference compensation gamma data curve to be generated by compensating a luminance characteristic deviation of a display panel in a reference luminance mode; a calculator to calculate a compensation gamma data curve for each of a plurality of luminance modes based on the reference compensation gamma data curve to perform a dimming operation; and a data signal generator to generate data signals corresponding to input grayscale levels based on the compensation gamma data curve.

The reference compensation gamma data curve may be generated by adding a standard gamma data curve and offset data for compensating the luminance characteristic deviation. The input grayscale levels may correspond to a same output data voltage in the standard gamma data curve.

The driver may include a compensation register to store the compensation gamma data curve, wherein the data signal generator is to generate the data signals based on the compensation gamma data curve stored in the compensation register. The calculator may calculate the compensation gamma data curve when the luminance mode of the display panel is changed. The compensation register may store the compensation gamma data curve when the luminance mode of the display panel is changed. The reference register may be a one-time programmable register.

A pixel in the display panel may emit light with a maximum luminance level corresponding to a maximum input grayscale level in the reference luminance mode. A pixel in the display panel may emit light with output luminance levels corresponding to the input grayscale levels based on a reference gamma curve in the reference luminance mode. The output luminance levels may be calculated based on the following equation:

$$D=k\times G^{1/\gamma}$$

where D is an output luminance level, K is a proportional constant, G is an input grayscale level, and γ is a gamma value. The gamma value may be set to about 2.2.

The reference register may store representative input grayscale levels selected from among the input grayscale levels and representative output data voltages corresponding to the representative input grayscale levels as the reference compensation gamma data curve. The data signal generator may generate the data signals using an interpolation algorithm for the representative output data voltages.

In accordance with one or more other embodiments, a display device includes a display panel including a plurality of pixels; and a display panel driver to drive the display panel, wherein the display panel driver includes: a reference register to store a reference compensation gamma data curve, the reference compensation gamma data curve to be generated by compensating a luminance characteristic deviation of a display panel in a reference luminance mode; a calculator to calculate a compensation gamma data curve for each luminance mode based on the reference compensation gamma data curve to perform a dimming operation; and a data signal generator to generate data signals corresponding to input grayscale levels based on the compensation gamma data curve.

The reference compensation gamma data curve may be generated by adding a standard gamma data curve and offset data for compensating the luminance characteristic deviation. The display panel driver may include a compensation register to store the compensation gamma data curve, wherein the data signal generator is to generate the data signals using the compensation gamma data curve stored in the compensation register. The calculator may calculate the compensation gamma data curve when the luminance mode of the display panel is changed.

The compensation register may store the compensation gamma data curve when the luminance mode of the display panel is changed. The reference register may store representative input grayscale levels selected from among the input grayscale levels and representative output data voltages corresponding to the representative input grayscale levels as the reference compensation gamma data curve. The data signal generator may generate the data signals using an interpolation algorithm for the representative output data voltages.

BRIEF DESCRIPTION OF THE DRAWINGS

Features will become apparent to those of skill in the art by describing in detail exemplary embodiments with reference to the attached drawings in which.

DESCRIPTION OF EMBODIMENTS

Figure 1:
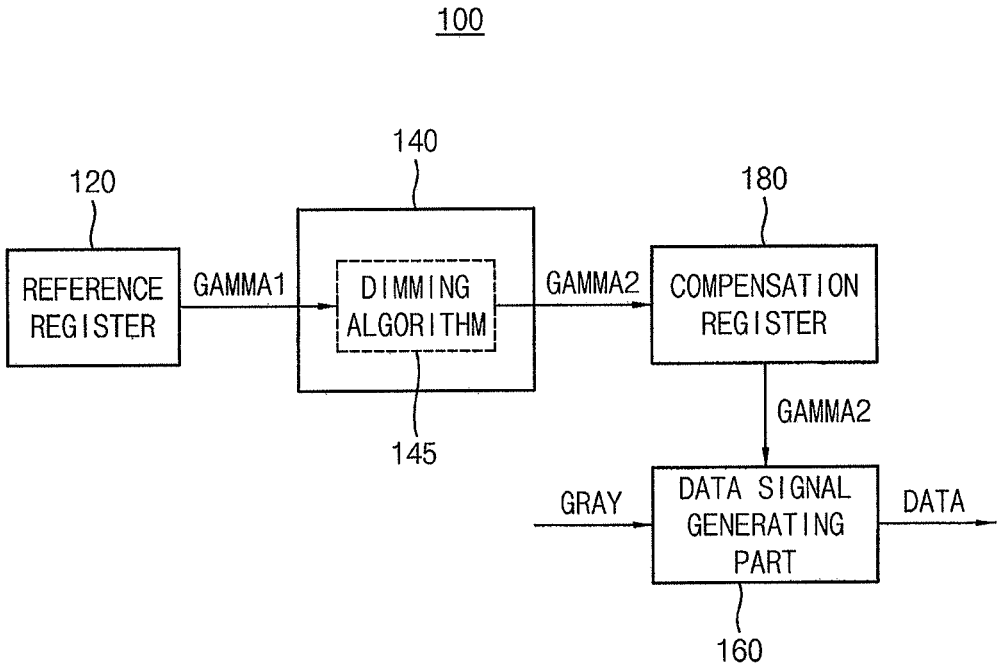
FIG. 1 illustrates an embodiment of a display panel driver.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
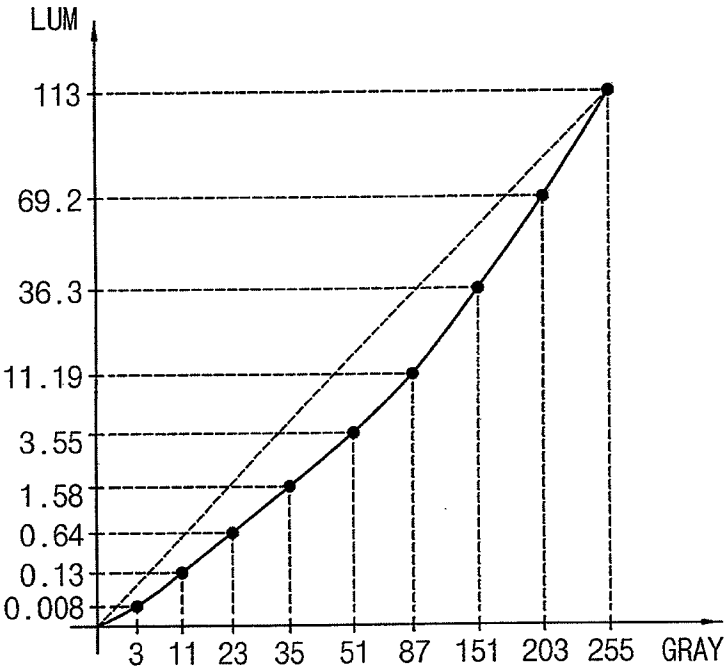
FIG. 2 illustrates a relationship between grayscale level and luminance.

FIG. 1 illustrates an embodiment of a display panel driver 100, and FIG. 2 illustrates an example of a relationship between grayscale level and luminance of light emitted by a pixel.

Referring to FIG. 1, the display panel driver 100 includes a reference register 120, a calculating part 140, and a data signal generating part 160. In some example embodiments, the display panel driver 100 may include a compensation register 180.

The reference register 120 stores a reference compensation gamma data curve GAMMA1. The gamma data curve may be indicative of a relationship between input grayscale level and output data voltage that corresponds to the voltage of a data signal. The reference compensation gamma data curve GAMMA1 may be generated, for example, by compensating luminance characteristic deviation of a display panel in a reference luminance mode. The luminance characteristic deviation of the display panel may be indicative of a difference between a gamma curve and luminance of output light corresponding to input grayscale levels GRAY. A luminance characteristic deviation may occur, for example, as a result of a manufacturing process of the display panel. The gamma curve may indicate a relationship between input grayscale level and the luminance of output light.

For example, the reference luminance mode may be set as 350 nit for a maximum input grayscale level. The luminance of the output light corresponding to the input grayscale level GRAY may be measured in the reference luminance mode. As a result, the difference between the luminance of the output light corresponding to input grayscale level GRAY and the gamma curve having 2.2 gamma value in the reference luminance mode (e.g., gamma setting) may be calculated. In other words, the luminance characteristic deviation may be calculated.

The data voltage may be controlled to control the luminance of the output light. Therefore, luminance characteristic deviation may be reduced by adjusting a relationship between the output data voltage and the input grayscale level GRAY. The reference compensation gamma data curve GAMMA1 may therefore be generated by compensating the luminance characteristic deviation. The reference register 120 may store the reference compensation gamma data curve GAMMA1.

In some example embodiments, the reference register 120 may be a one-time programmable (OTP) register. Since the reference compensation gamma data curve GAMMA1 doles not have to be changed, the reference compensation gamma data curve GAMMA1 may be maintained with an initial value. Thus, the reference compensation gamma data curve GAMMA1 may be stored in the one-time programmable register.

In some example embodiments, the reference compensation gamma data curve GAMMA1 may be generated by adding a standard gamma data curve and offset data for compensating the luminance characteristic deviation. In the standard gamma data curve, the input grayscale levels GRAY may correspond to a same output data voltage. For example, all input grayscale levels GRAY may correspond to the initial value having 5V. Therefore, the offset data may be added to the standard gamma data curve to generate the reference compensation gamma data curve GAMMA1.

In some example embodiments, a pixel in the display panel may emit light with a maximum luminance level corresponding to a maximum input grayscale level in the reference luminance mode. Thus, the pixel may emit the light with the maximum luminance level in the reference luminance mode. For example, the pixel may emit light with 113 nit for the maximum input grayscale level (e.g., 255 grayscale) in the reference luminance mode.

In some example embodiments, the pixel in the display panel may emit a light with output luminance levels corresponding to the input grayscale levels GRAY using a reference gamma curve in the reference luminance mode. The pixel may receive the output data voltage generated using the reference compensation gamma data curve GAMMA1 that is generated by compensating the luminance characteristic deviation in the reference luminance mode. Therefore, the pixel may emit the light with the output luminance level corresponding to the input grayscale levels GRAY using the reference gamma curve. The reference gamma curve may be a target gamma curve in the reference luminance mode. The output luminance levels may be calculated, for example, based on Equation 1.

$$D=k\times G^{1/\gamma} \tag{1}$$

wherein D is an output luminance level, K is a proportional constant, G is an input grayscale level, and γ is a gamma value. In one example, the gamma value may be about 2.2 in Equation 1.

In some example embodiments, the reference register 120 may store representative input grayscale levels selected from among the input grayscale levels and representative output data voltages corresponding to the representative input grayscale levels as the reference compensation gamma data curve GAMMA1.

Referring to FIGS. 1 and 2, output luminance levels may correspond to input grayscale levels according to the reference gamma curve GAMMA1. Also, output data voltages may correspond to input grayscale levels according to the reference gamma data curve GAMMA1.

For example, when the reference luminance mode is set as 113 nit for the maximum input grayscale level, 11 input grayscale may correspond to an output luminance having 0.13 nit according to the reference gamma curve having about 2.2 gamma value. Furthermore, 11 input grayscale may correspond to an output data voltage having 6.21485 V according to a reference compensation gamma data curve GAMMA1 of a red color light, may correspond to an output data voltage having 6.20253 V according to the reference compensation gamma data curve GAMMA1 of a green color light, and may correspond to an output data voltage having 5.82159 V according to the reference compensation gamma data curve GAMMA1 of a blue color light. Since the output luminance levels corresponding to input grayscale levels are target luminance levels to which the output light aims, the output luminance levels corresponding to input grayscale levels may be subject to change. The output data voltages for each of the display panels corresponding to input grayscale levels may have difference values to compensate the luminance characteristic deviation of the display panel.

In some example embodiments, a reference register 120 may store output data voltages that correspond to all input grayscale levels GRAY. However, in this case, the size of the register may be increased in order to have enough space to store the reference compensation gamma data curve. This increases manufacturing costs.

As shown in FIG. 2, the reference register 120 may store may store representative input grayscale levels, selected from among the input grayscale levels and representative output data voltages corresponding to the representative input grayscale levels GRAY, as the reference compensation gamma data curve GAMMA1. For example, grayscale levels of 3, 11, 23, 35, 51, 87, 151, 203, and 255 may be set as the representative input grayscale levels. In this case, the reference register 120 may store the representative input grayscale levels and representative output data voltages corresponding to the representative input grayscale levels as the reference compensation gamma data curve GAMMA1. In one example, the reference register 120 for a compensation gamma data curve of a blue color light may store 23 grayscale as the representative input grayscale level and 5.7153 V as the representative output data voltages.

In FIG. 1, the calculating part 140 calculates a compensation gamma data curve GAMMA2 for each luminance mode based on the reference compensation gamma data curve GAMMA1 to perform a dimming operation.

The dimming operation may adjust a gamma curve by changing a maximum luminance according to a surrounding condition of the display panel. Also, the gamma data curve may be adjusted corresponding to the adjusted gamma curve. Furthermore, the compensation gamma data curve GAMMA2 may be adjusted for compensating the luminance characteristic deviation of the display panel. The calculating part 140 may calculate the compensation gamma data curve GAMMA2 for each luminance mode using a dimming algorithm 145 for the reference compensation gamma data curve GAMMA1.

In some example embodiments, the calculating part 140 may calculate the compensation gamma data curve GAMMA2 when the luminance mode of the display panel is changed. The luminance mode may be changed, for example, by user control or a predetermined algorithm. Since the gamma curve may be changed when the luminance mode is changed, the calculating part 140 may calculate the compensation gamma data curve GAMMA2 when the luminance mode is changed.

In some example embodiments, the calculating part 140 may generate a table that includes representative input grayscale levels and output data voltages corresponding to representative input grayscale levels.

The data signal generating part 160 may generate a data signal DATA. The data signal DATA may have output data voltages corresponding to the input grayscale levels GRAY based on the compensation gamma data curve GAMMA2 in respective luminance modes. For example, the data signal generating part 160 may determine voltage levels corresponding to input grayscale levels in input image data using the compensation gamma data curve GAMMA2. The data signal generating part 160 may generate the data signal DATA having the determined voltage levels.

In some example embodiments, the data signal generating part 160 may generate the data signals DATA using an interpolation algorithm for the representative output data voltages. When the reference register 120 stores representative input grayscale levels selected from among the input grayscale levels and representative output data voltages corresponding to the representative input grayscale levels as the reference compensation gamma data curve GAMMA1, the calculating part 140 may calculate the output data voltages corresponding to the representative input grayscale levels. Therefore, the data signal generating part 160 may generate the data signals DATA using an interpolation algorithm for the representative output data voltages.

The compensation register 180 may store the compensation gamma data curve GAMMA2. The data signal generating part 160 may generate the data signal DATA using the compensation gamma data curve GAMMA2 stored in the compensation register 180.

In some example embodiments, the compensation register 180 may store the compensation gamma data curve GAMMA2 when the luminance mode of the display panel is changed. The calculating part 140 may calculate the compensation gamma data curve GAMMA2 when the luminance mode of the display panel is changed. Therefore, the compensation register 180 may store the calculated compensation gamma data curve GAMMA2 when the luminance mode of the display panel is changed.

As a result, the compensation register 180 may store the compensation gamma data curve GAMMA2 calculated based on the reference compensation gamma data curve GAMMA1, to thereby prevent overflow of the register.

Figure 3:
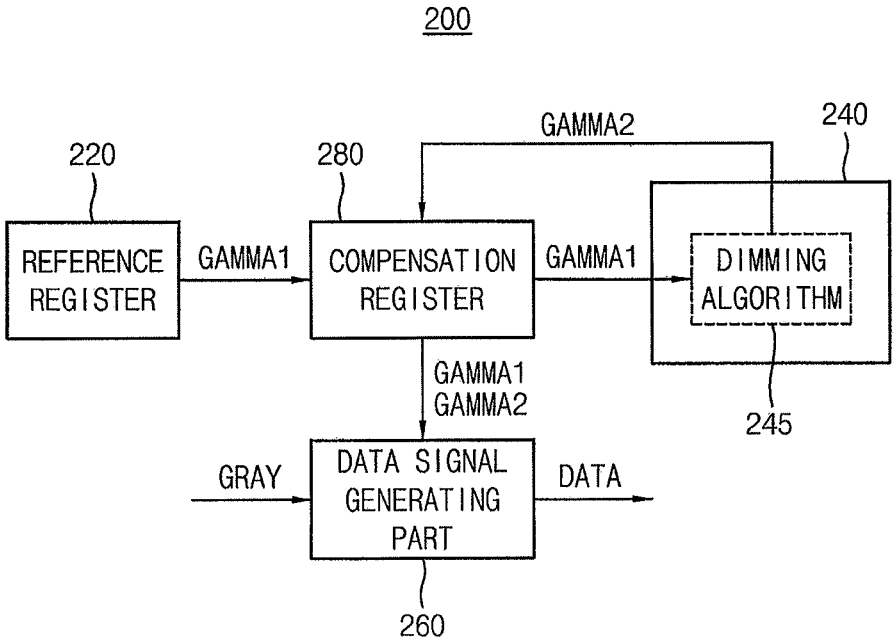
FIG. 3 illustrates another embodiment of a display panel driver.

FIG. 3 illustrates an embodiment of a display panel driver 200 which includes a reference register 220, a calculating part 240, and a data signal generating part 260. In some example embodiments, the display panel driver 200 may also include a compensation register 280.

The reference register 220 may store a reference compensation gamma data curve GAMMA1. The reference compensation gamma data curve GAMMA1 may be generated by compensating a luminance characteristic deviation of the display panel in the reference luminance mode.

The data voltage may be controlled to control the luminance of the output light. Therefore, the luminance characteristic deviation may be reduced by adjusting the relationship between the output data voltage and the input grayscale level GRAY. Foe example, the reference compensation gamma data curve GAMMA1 may be generated by compensating the luminance characteristic deviation of the display panel. The reference register 220 may store the reference compensation gamma data curve GAMMA1.

The calculating part 240 may calculate the compensation gamma data curve GAMMA2 for each luminance mode based on the reference compensation gamma data curve GAMMA1 to perform a dimming operation. In one example embodiment, the calculating part 240 may calculate a new compensation gamma data curve based on the compensation gamma data curve GAMMA2 stored in the compensation register 280.

The compensation register 280 may store the compensation gamma data curve GAMMA2. In comparison with FIG. 1, the compensation register 280 may store the reference compensation gamma data curve GAMMA1 derived from the reference register 220. When the display panel operates in the reference luminance mode, the compensation register 280 may store the reference compensation gamma data curve GAMMA1 as the compensation gamma data curve GAMMA2. This is because a dimming operation is not necessary for the reference compensation gamma data curve GAMMA1. Also, the reference compensation gamma data curve GAMMA1 may be provided to the data signal generating part 260 as the compensation gamma data curve GAMMA2.

However, when the display panel does not operate in the reference luminance mode, the compensation register 280 may store the compensation gamma data curve GAMMA2 calculated by calculating part 240, instead of the reference compensation gamma data curve GAMMA1.

The data signal generating part 260 may generate a data signal DATA. For example, the data signal generating part 260 may generate the data signal DATA based on the compensation gamma data curve GAMMA2 stored in the compensation register 280.

As a result, the compensation register 280 may store the reference compensation gamma data curve GAMMA1 and the compensation gamma data curve GAMMA2 calculated based on the reference compensation gamma data curve GAMMA1, thereby preventing overflow of the register.

Figure 4:
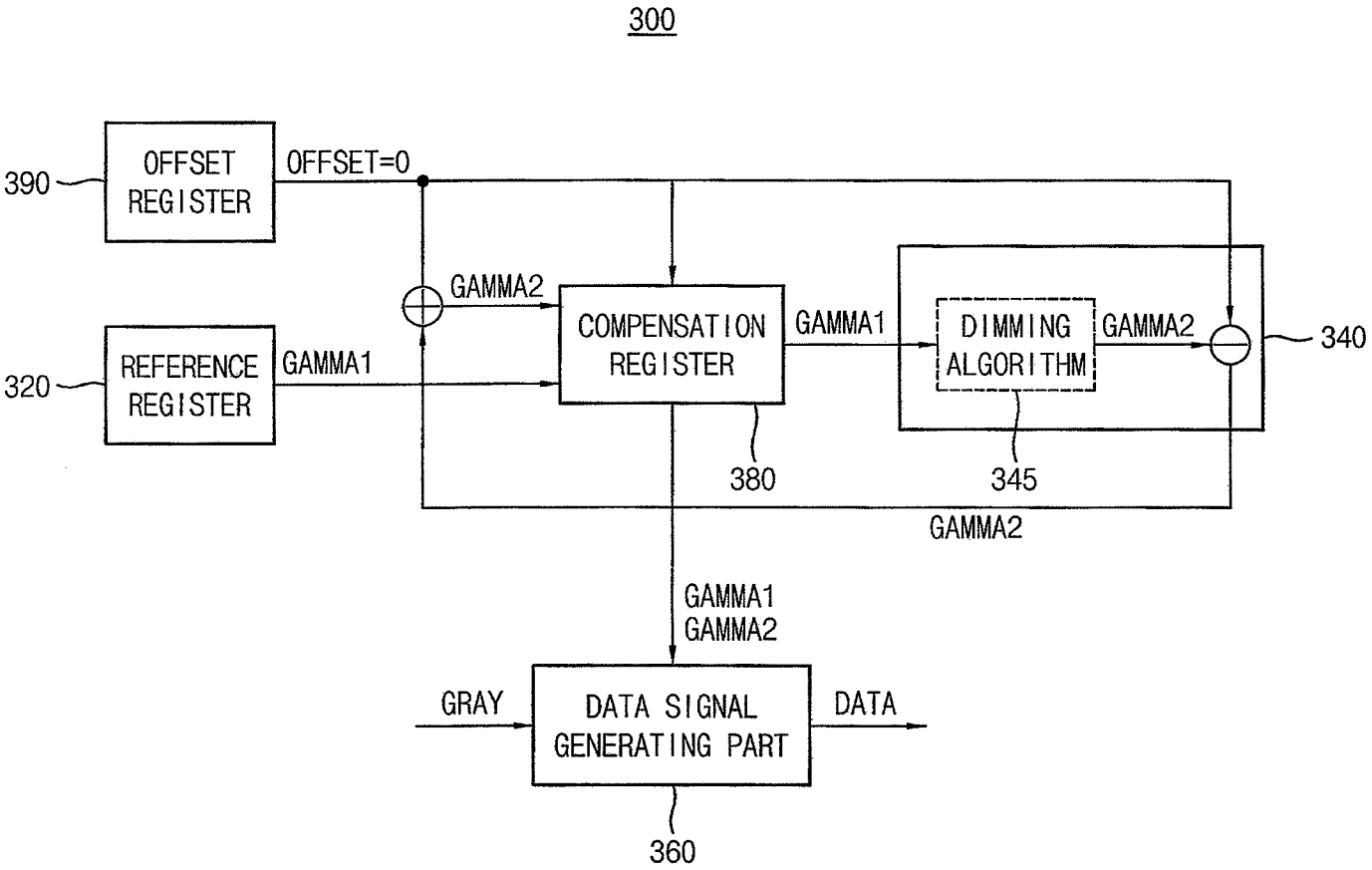
FIG. 4 illustrates another embodiment of a display panel driver.
Figure 5:
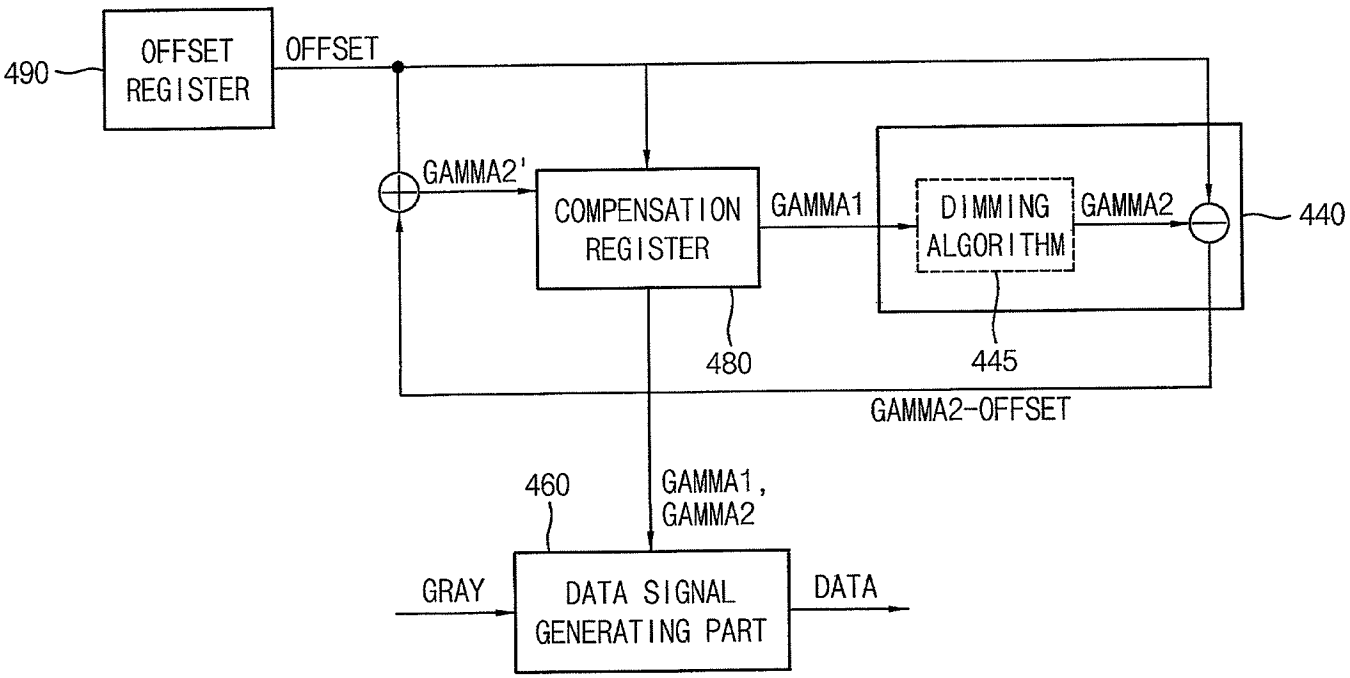
FIG. 5 RELATED ART
FIG. 5 illustrates one type of display panel driver which has been proposed.

FIG. 4 illustrates another embodiment of a display panel driver 300, and FIG. 5 illustrates another type of display panel driver 400 which has been proposed. Referring to FIG. 4, the display panel driver 300 includes a reference register 320, a calculating part 340, a data signal generating part 360, a compensation register 380, a offset register 390. The reference register 320 stores a reference compensation gamma data curve GAMMA1, which, for example, may be generated by compensating a luminance characteristic deviation in a reference luminance mode.

The data voltage may be controlled to control the luminance of the output light. Therefore, the luminance characteristic deviation may be reduced by adjusting the relationship between the output data voltage and the input grayscale level GRAY. For example, the reference compensation gamma data curve GAMMA1 may be generated by compensating the luminance characteristic deviation of the display panel. The reference register 320 may store the reference compensation gamma data curve GAMMA1.

Referring to FIG. 5, display panel driver 400 includes a calculating part 440, a data signal generating part 460, a compensation register 480, and an offset register 490. The calculating part 440 may respectively calculate the compensation gamma data curve GAMMA2 for each of luminance modes based on the reference compensation gamma data curve GAMMA1 in each luminance mode to perform a dimming operation. Also, the calculating part 440 may calculate a difference value GAMMA2−OFFSET between the compensation gamma data curve GAMMA2 and an offset data OFFSET stored in the conventional offset register 490. The difference value GAMMA2−OFFSET may be added with the offset data OFFSET again to generate a new compensation gamma data curve GAMMA2'. The new compensation gamma data curve GAMMA2' may be stored in the compensation register 480 as a new compensation gamma data curve GAMMA2'.

In this case, the difference value GAMMA2−OFFSET calculated by the calculating part 440 may be stored in a register in the calculating part 440. However, the difference value GAMMA2−OFFSET may exceed the limited range of this register. Therefore, a boundary value may be stored in the register instead of the difference value GAMMA2−OFFSET. Consequently, an overflow condition of the register may occur. As a result, the new compensating gamma data curve GAMMA2', generated by adding offset data OFFSET, may be different from the compensation gamma data curve GAMMA2 calculated by the calculating part 440.

In contrast, the calculating part 340 in FIG. 4 calculates the compensation gamma data curve GAMMA2 for each luminance mode based on the reference compensation gamma data curve GAMMA1 to perform the dimming operation. The calculating part 340 may calculate the compensation gamma data curve GAMMA2 for each luminance mode using the dimming algorithm 345 based on the reference compensation gamma data curve GAMMA1. In some example embodiments, the calculating part 340 may calculate a new compensation gamma data curve based on the compensation gamma data curve stored in the compensation register 380. The calculating part 340 may calculate the new compensation gamma data curve for a changed luminance mode using the dimming algorithm 345 based on the compensation gamma data curve.

The calculating part 340 may calculate a difference value GAMMA2−OFFSET between the compensation gamma data curve GAMMA2 and the offset data stored in the offset register 390. However, the offset data may be set. Therefore, the difference value GAMMA2−OFFSET may equal to the compensation gamma data curve. In this case, overflow of the register may not occur unlike the calculating part 440 in FIG. 5.

The compensation register 480 may store the new compensation gamma data curve GAMMA2', instead of the reference compensation gamma data curve GAMMA1. The data signal generating part 460 may generate a data signal DATA using the compensation gamma data curve GAMMA2' stored in the compensation gamma data curve register 480.

In FIG. 4, the compensation register 380 may store the new compensation gamma data curve GAMMA2, instead of the reference compensation gamma data curve GAMMA1, like compensation register 480. The data signal generating part 360 may generate the data signal DATA using the compensation gamma data curve GAMMA2 stored in the compensation register 380 like the data signal generating part 460.

As a result, the compensation register 380 may store the calculated compensation gamma data curve GAMMA2 based on the reference compensation gamma data curve GAMMA1 and the reference compensation gamma data curve GAMMA1, thereby overflow of the register may not occur.

Figure 6:
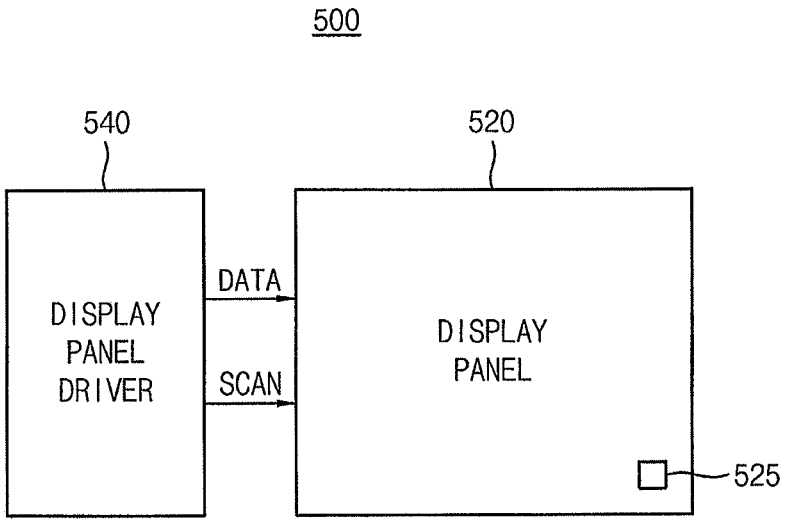
FIG. 6 illustrates an embodiment of a display device.

FIG. 6 illustrates an embodiment of a display device 500 which includes a display panel 520 and a display panel driver 540. The display panel 520 includes a plurality of pixels 525. The display panel driver 540 drives the display panel 520. The display panel driver 540 may provide a data signal DATA to the pixels 525 when a scan signal SCAN is activated. In some example embodiments, the display panel driver 540 may include a scan driver that generates the scan signal SCAN.

The display driver 540 may include a reference register, a calculating part, and a data signal generating part. The reference register may store a reference compensation gamma data curve. The reference compensation gamma data curve may be generated by compensating a luminance characteristic deviation of the display panel 520 in a reference luminance mode. The luminance characteristic deviation of the display panel 520 may correspond to a difference between a gamma curve and a luminance of an output light of the display panel corresponding to input grayscale levels. The luminance characteristic deviation may occur, for example, during a manufacturing process of the display panel.

The data voltage may be controlled to control the luminance of the output light. Therefore, the luminance characteristic deviation of display panel 520 may be reduced by adjusting a relationship between the output data voltage and the input grayscale level. Thus, the reference compensation gamma data curve may be generated by compensating the luminance characteristic deviation of the display panel 520. The reference register may store the reference compensation gamma data curve.

In some example embodiments, the reference register may be a one-time programmable (OTP) register. Since the reference compensation gamma data curve needs not to be changed, the reference compensation gamma data curve may be maintained with an initial value. Thus, the reference compensation gamma data curve may be stored in the one-time programmable register.

In some example embodiments, the reference compensation gamma data curve may be generated by adding a standard gamma data curve and offset data for compensating the luminance characteristic deviation. In the standard gamma data curve, the input grayscale levels may correspond to a same output data voltage. Therefore, the offset data may be added to the standard gamma data curve to generate the reference compensation gamma data curve.

In some example embodiments, a pixel 525 may emit a light with a maximum luminance level corresponding to a maximum input grayscale level in the reference luminance mode. Thus, the pixel may emit the light with a maximum luminance level in the reference luminance mode.

In some example embodiments, the pixel 525 may emit a light with output luminance levels corresponding to the input grayscale levels using a reference gamma curve in the reference luminance mode. The pixel 525 may receive the output data voltage generated using the reference compensation gamma data curve that is generated by compensating the luminance characteristic deviation in the reference luminance mode. Therefore, the pixel 525 may emit the light with the output luminance level corresponding to the input grayscale levels using the reference gamma curve. The output luminance levels may be calculated, for example, based on Equation 1. Furthermore, the gamma value may be set, for example, to about 2.2 in Equation 1.

In some example embodiments, the reference register may store representative input grayscale levels selected from among the input grayscale levels and representative output data voltages corresponding to the representative input grayscale levels as the reference compensation gamma data curve.

The calculating part may calculate the compensation gamma data curve for each luminance mode based on the reference compensation gamma data curve to perform a dimming operation. The calculating part may calculate the compensation gamma data curve for each luminance mode using a dimming algorithm for the reference compensation gamma data curve.

In some example embodiments, the calculating part may calculate the compensation gamma data curve when the luminance mode of the display panel 520 is changed. The luminance modes may be changed, for example, by user control or a predetermined algorithm. Since the gamma curve may be changed when the luminance mode is changed, the calculating part may calculate the compensation gamma data curve when the luminance mode is changed.

In some example embodiments, the calculating part may generate a table that includes representative input grayscale levels and output data voltages corresponding to representative input grayscale levels.

The data signal generating part may generate a data signal DATA. The data signal DATA may have the output data voltages corresponding to the input grayscale levels based on the compensation gamma data curve in respective luminance modes. For example, the data signal generating part may determine voltage levels corresponding to input grayscale levels in input image data using the compensation gamma data curve. The data signal generating part may generate data signal DATA having the determined voltage levels.

In some example embodiments, the data signal generating part may generate the data signals DATA using an interpolation algorithm for the representative output data voltages. When the reference register stores representative input grayscale levels selected from among the input grayscale levels and representative output data voltages corresponding to the representative input grayscale levels as the reference compensation gamma data curve, the calculating part may calculate the output data voltages corresponding to the representative input grayscale levels. Therefore, the data signal generating part may generate the data signals DATA using an interpolation algorithm for the representative output data voltages.

The compensation register may store the compensation gamma data curve. The data signal generating part may generate the data signal DATA using the compensation gamma data curve stored in the compensation register.

In some example embodiments, the compensation register may store the compensation gamma data curve when the luminance mode of the display panel 520 is changed. The calculating part may calculate the compensation gamma data curve when the luminance mode of the display panel is changed. Therefore, the compensation register 180 may store the calculated compensation gamma data curve GAMMA2 when the luminance mode of the display panel is changed.

As a result, the compensation register may store the compensation gamma data curve that is calculated based on the reference compensation gamma data curve, thereby preventing overflow of the register.

The parts, signal processors, generators, and other calculating features of the embodiments described herein may be implemented in logic which, for example, may include hardware, software, or both. When implemented at least partially in hardware, the parts, signal processors, generators, and other calculating features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the parts, signal processors, generators, and other calculating features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Although the example embodiments describe that the pixel may emit light with 113 nit for the maximum input grayscale level in the reference luminance mode, the pixel may emit light with another nit value for the maximum grayscale level in another embodiment.

By way of summation and review, when a display panel driver performs a dimming operation, the display panel driver may store a setting value for the dimming algorithm in a register. However, the register only can store values of a limited range. When the limited range of the register is exceeded, an overflow condition occurs for the register, which may translate into degraded display performance.

In accordance with one or more of the aforementioned embodiments, In the present invention, the display panel driver calculates a compensation gamma data curve for each luminance mode based on the reference luminance compensation gamma curve. Therefore, an overflow of the register may not occur In other example embodiments, a display panel driver calculates a compensation data curve for each of a plurality of luminance modes based on a reference luminance compensation data curve. As a result, an overflow condition of the register may be prevented, along with degradation in display quality. Also, offset data may be set to a predetermined value (e.g., 0) because a D-IC register may be used without requiring a change in structure.

Example embodiments have been disclosed herein, and although specific teens are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display panel driver, comprising:

a reference register to store a reference compensation gamma data curve, the reference compensation gamma data curve to be generated by compensating a luminance characteristic deviation of a display panel in a reference luminance mode;

a calculator to calculate a compensation gamma data curve for each of a plurality of luminance modes based on the reference compensation gamma data curve to perform a dimming operation; and a data signal generator to generate data signals corresponding to input grayscale levels based on the compensation gamma data curve.

2. The driver as claimed in claim 1, wherein the reference compensation gamma data curve is to be generated by adding a standard gamma data curve and offset data for compensating the luminance characteristic deviation.

3. The driver as claimed in claim 2, wherein the input grayscale levels correspond to a same output data voltage in the standard gamma data curve.

4. The driver as claimed in claim 1, further comprising:

a compensation register to store the compensation gamma data curve, wherein the data signal generator is to generate the data signals based on the compensation gamma data curve stored in the compensation register.

5. The driver as claimed in claim 4, wherein the calculator is to calculate the compensation gamma data curve when the luminance mode of the display panel is changed.

6. The driver as claimed in claim 5, wherein the compensation register is to store the compensation gamma data curve when the luminance mode of the display panel is changed.

7. The driver as claimed in claim 1, wherein the reference register is a one-time programmable register.

8. The driver as claimed in claim 1, wherein a pixel in the display panel is to emit light with a maximum luminance level corresponding to a maximum input grayscale level in the reference luminance mode.

9. The driver as claimed in claim 1, wherein a pixel in the display panel is to emit light with output luminance levels corresponding to the input grayscale levels based on a reference gamma curve in the reference luminance mode.

10. The driver as claimed in claim 9, wherein the output luminance levels are to be calculated based on the following equation:

$$D=k\times G^{1/\gamma}$$

wherein D is an output luminance level, K is a proportional constant, G is an input grayscale level, and γ is a gamma value.

11. The driver as claimed in claim 10, wherein the gamma value is set to about 2.2.

12. The driver as claimed in claim 1, wherein the reference register is to store representative input grayscale levels selected from among the input grayscale levels and representative output data voltages corresponding to the representative input grayscale levels as the reference compensation gamma data curve.

13. The driver as claimed in claim 12, wherein the data signal generator is to generate the data signals using an interpolation algorithm for the representative output data voltages.

14. A display device, comprising:

a display panel including a plurality of pixels; and a display panel driver to drive the display panel, wherein the display panel driver includes:

a reference register to store a reference compensation gamma data curve, the reference compensation gamma data curve to be generated by compensating a luminance characteristic deviation of a display panel in a reference luminance mode;

a calculator to calculate a compensation gamma data curve for each luminance mode based on the reference compensation gamma data curve to perform a dimming operation; and a data signal generator to generate data signals corresponding to input grayscale levels based on the compensation gamma data curve.

15. The display device as claimed in claim 14, wherein the reference compensation gamma data curve is to be generated by adding a standard gamma data curve and offset data for compensating the luminance characteristic deviation.

16. The display device as claimed in claim 14, wherein the display panel driver includes:

a compensation register to store the compensation gamma data curve, wherein the data signal generator is to generate the data signals using the compensation gamma data curve stored in the compensation register.

17. The display device as claimed in claim 16, wherein the calculator is to calculate the compensation gamma data curve when the luminance mode of the display panel is changed.

18. The display device as claimed in claim 17, wherein the compensation register is to store the compensation gamma data curve when the luminance mode of the display panel is changed.

19. The display device as claimed in claim 14, wherein the reference register is to store representative input grayscale levels selected from among the input grayscale levels and representative output data voltages corresponding to the representative input grayscale levels as the reference compensation gamma data curve.

20. The display device as claimed in claim 19, wherein the data signal generator is to generate the data signals using an interpolation algorithm for the representative output data voltages.

* * * * *